US007141149B2

(12) United States Patent
Edwards et al.

(10) Patent No.: US 7,141,149 B2
(45) Date of Patent: Nov. 28, 2006

(54) ELECTRODES USEFUL FOR MOLTEN SALT ELECTROLYSIS OF ALUMINUM OXIDE TO ALUMINUM

(75) Inventors: Leslie C. Edwards, Chalmette, LA (US); M. Franz Vogt, Chalmette, LA (US); Richard O. Love, Ravenswood, WV (US); J. Anthony Ross, Ravenswood, WV (US); William Rogers Morgan, Jr., Hawesville, KY (US)

(73) Assignees: CII Carbon LLC, Kingwood, TX (US); Century Aluminum Company, Monterey, CA (US)

( * ) Notice: Subject to any disclaimer, the term of this patent is extended or adjusted under 35 U.S.C. 154(b) by 350 days.

(21) Appl. No.: 10/874,508

(22) Filed: Jun. 22, 2004

(65) Prior Publication Data

US 2005/0279627 A1 Dec. 22, 2005

(51) Int. Cl.
*C25B 11/12* (2006.01)

(52) U.S. Cl. ..... 204/294; 252/511; 264/29.1; 264/105; 423/460; 205/386

(58) Field of Classification Search ..... 204/294; 205/386; 423/460; 252/511; 264/29.1, 264/105
See application file for complete search history.

(56) References Cited

U.S. PATENT DOCUMENTS 3,645,862 A 2/1972 Cotton et al.
4,096,097 A * 6/1978 Yan ..... 252/510
4,173,518 A 11/1979 Yamada et al.
4,307,052 A 12/1981 Gannono et al.
4,369,171 A * 1/1983 Grindstaff et al. ..... 423/461
4,897,170 A 1/1990 Chandramouli
5,073,611 A 12/1991 Rehmer et al.
5,389,353 A * 2/1995 Glaeser et al. ..... 423/492
6,380,322 B1 4/2002 Wong et al.
2004/0076571 A1* 4/2004 Drouin et al. ..... 423/245.3
2005/0135991 A1* 6/2005 Engle et al. ..... 423/492

OTHER PUBLICATIONS

Beck, Theodor R., "Electrolytic Production of Aluminum," Electrochemistry Encyclopedia, Oct. 2001, Electrochemical Technology Corp.

* cited by examiner

*Primary Examiner*—Bruce F Bell
(74) *Attorney, Agent, or Firm*—Walter A. Hackler

(57) ABSTRACT

The present invention provides a method of making a carbon electrode, suitable for use as an anode in an aluminum reduction cell, which comprises mixing an aggregate, comprising a mixture of particulate shot coke, and a particulate carbonaceous material other than shot coke with coal tar pitch or petroleum pitch or a combination of these pitches at an elevated temperature to form a paste wherein said aggregate comprises a combination of coarse, medium, and fine particles and said particulate shot coke may comprise a majority of said fine particles, and said paste comprises from about 80 to about 90%, by weight, of said aggregate and from about 10 to about 20%, by weight, of said pitch; forming said paste into a solid body; and baking said solid body at an elevated temperature to form said carbon electrode.

15 Claims, No Drawings

ELECTRODES USEFUL FOR MOLTEN SALT ELECTROLYSIS OF ALUMINUM OXIDE TO ALUMINUM

The present invention relates to an electrode for use in the manufacture of aluminum by molten salt electrolysis of aluminum oxide. More particularly, it relates to an electrode, specifically to an anode, for use in aluminum reduction cells.

It has been known to manufacture aluminum by molten salt electrolysis of aluminum oxide dissolved in a bath of the fluorides of aluminum and sodium, or cryolite, using a carbon anode. Usually, such an electrolysis process is conducted at about 900° to 1000° Centigrade. In this process, the carbon anode is consumed by oxidation due to the oxygen produced by the decomposition of aluminum oxide to the aluminum metal.

In commercial anode production processes, calcined sponge petroleum cokes or coal tar pitch cokes, along with recycled carbon anode remnants or butts, are used to provide an aggregate which is bound with coal tar pitch or a combination of coal tar and petroleum pitches (combination pitch) and subsequently shaped and heated at an elevated temperature, e.g. about 1100° C., to form the commercial anode. The manufacture of such commercial anodes requires a coke that has low volatile matter, vanadium and nickel under 500 ppm and sulfur under 4%, by weight, and preferably under 3%, by weight. Such coke is preferably calcined, sponge coke. Shot coke, with its higher impurity levels, more isotropic structure and higher thermal expansion coefficient when calcined has never been successfully used for such commercial anodes.

In particular, carbon anodes, made from an aggregate comprising more than 5%, by weight, shot coke, exhibit a propensity for thermal shock cracking due to the high coefficient of thermal expansion and the anode strength is weakened due to the difficulty in binding shot coke particles with coal tar or combination pitch. As a result, the anode scrap rates are unacceptably high and anode carbon loss in the aluminum reduction cells creates a serious and unacceptable disruption to the smelting process.

When discussing petroleum coke, it is essential to recognize that there are three different types of coking processes and the petroleum coke produced from each is distinctly different. These processes—delayed, fluid and flexicoking—are all effective in converting heavy hydrocarbon oil fractions to higher value, lighter hydrocarbon gas and liquid fractions and concentrating the contaminants (sulfur, metals, etc.) in the coke.

Petroleum coke from the delayed process is described as delayed sponge, shot or needle coke depending on its physical structure. Shot is most prevalent when running the unit under severe conditions with very heavy crude oil residuum containing a high proportion of asphaltenes. Needle coke is produced from selected aromatic feedstocks. Although the chemical properties are most critical, the physical characteristics of each coke type play a major role in the final application of the coke. For example, sponge coke is more porous and contains greater surface area; if the quality is acceptable, it may be sold to the calcining industry as a raw material for anode coke production where it has a higher value. Shot coke looks like BB's, has much less surface area and is harder; it is almost always sold as a fuel coke for a relatively low value. Needle coke's unique structure lends to its use for graphitized electrodes. Unlike the others, needle coke is a product (not a by-product) which the refinery intentionally produces from selected hydrocarbon feedstocks.

Shot coke is characterized by small round spheres of coke, the size of BB's, loosely bound together. Occasionally, they agglomerate into ostrich egg sized pieces. While shot coke may look like it is entirely made up of shot, most shot coke is not 100% shot. Interestingly, even sponge coke may have some measurement of embedded shot coke. A low shot coke percentage in petroleum coke is preferably specified for anode grades of petroleum coke.

Shot coke, while useful as a fuel, is less valuable than sponge coke which can be used to prepare the more valuable carbon anodes. It is therefore desirable to find a way to use the less valuable shot coke in an application having a greater value, i.e. to manufacture carbon anodes, provided said carbon anodes do not have poor quality.

SUMMARY OF THE INVENTION

Preferably, in accordance with the present invention, the aggregate comprises more than 5%, by weight, of shot coke and may comprise up to 90%, by weight, of shot coke. The shot coke must be calcined to remove most of the volatiles prior to use in the method of the invention.

The calcined shot coke may be milled to provide fine particles. For the purposes of the present invention, fine particles are defined as those whereby 100% will pass through a 60 mesh, Tyler Sieve Size and approximately 70% or more will pass through a 200 mesh U.S. Standard Sieve Size.

The milling process to obtain the above fine particles is common knowledge in the art and need not be disclosed herein.

The particulate shot coke may have a sulfur content of up to 8%, by weight. It is generally undesirable for the coke utilized in the manufacture of carbon electrodes for use in an aluminum reduction cell to have a sulfur content of greater than about 4%.

The remainder of the aggregate may comprise any particulate carbonaceous material that is suitable for preparing carbon electrodes, including recycled anode butts, for use in aluminum reduction cells. Such carbonaceous materials are well known in the art.

Preferably, said carbonaceous material is selected from the group consisting of sponge, needle or pitch cokes, and recycled carbon electrode remnants.

It has now been discovered that a satisfactory carbon electrode, suitable for use in an aluminum reduction cell may be prepared from a particulate carbonaceous, aggregate, preferably comprising more than 5%, by weight, of shot coke.

Thus, the present invention provides a method of making a carbon electrode, suitable for use as an anode in an aluminum reduction cell, which comprises mixing an aggregate, comprising a mixture of particulate shot coke, recycled anode butts, and a particulate carbonaceous material other than shot coke with coal tar pitch or combination pitch at an elevated temperature to form a paste wherein said aggregate comprises a combination of coarse, medium, and fine particles and said paste comprises up to about 90%, by weight, of said aggregate and from about 10 to about 20%, by weight, of said coal tar pitch or combination pitch; forming said paste into a solid body; and baking said solid body at an elevated temperature to form said carbon electrode.

DETAILED DESCRIPTION

In the method of the invention, the aggregate is combined with a coal tar pitch binder or a combination pitch binder.

Coal tar pitch is a residue produced by distillation or heat treatment of coal tar. It is a solid at room temperature, consists of a complex mixture of numerous predominantly aromatic hydrocarbons and heterocyclics, and exhibits a broad softening range instead of a defined melting temperature. Petroleum pitch is a residue from heat treatment and distillation of petroleum fractions. It is solid at room temperature, consists of a complex mixture of numerous predominantly aromatic and alkyl-substituted aromatic hydrocarbons, and exhibits a broad softening range instead of a defined melting temperature. Combination pitch is a mixture or combination of coal tar pitch and petroleum pitch.

The hydrogen aromaticity in coal tar pitch (ratio of aromatic to total content of hydrogen atoms) varies from 0.7 to 0.9. The hydrogen aromaticity (ratio of aromatic to total hydrogen atoms) varies between 0.3 and 0.6. The aliphatic hydrogen atoms are typically present in alkyl groups substituted on aromatic rings or as naphthenic hydrogen.

The aggregate utilized in the method of the present invention comprises a mixture of fine, medium and coarse particles. The mesh sizes for the fine particles are defined above. Medium particles will pass through a 4 mesh Tyler sieve and be retained on a 60 mesh screen. Coarse particles, which may also contain recycled anode butts, will be retained on a 16 mesh Tyler screen. It is noted, however, that coarse particles having a mesh size of over 2.5 mesh are generally to be excluded from the aggregates utilized in the method of the present invention.

The aggregate is combined and mixed with the coal tar pitch or combination pitch. There are numerous mixing schemes in the art. Any of them may be adapted for shot coke use, simply by treating the shot aggregate in the same way as the current aggregate is combined with the pitch.

It is important that the aggregate and the pitch are mixed together at an elevated temperature, e.g. greater than 150° C., in order to coat the particles with pitch, penetrate the pitch and the fine particles into the internal pores of the medium and coarse particles and fill the interstitial aggregate volume with the pitch and the fine particles.

After mixing the aggregate and the coal tar pitch for 1 to 45 minutes, e.g. from 10 to 20 minutes, a paste is formed.

The paste may be formed into a solid body, by methods known in the art, e.g. pressing or vibroforming, prior to baking to form the electrode.

The green electrode is baked at an elevated temperature to provide a carbon electrode suitable for use in an aluminum reduction cell. Preferably, the green electrode is baked at a temperature of from 1000° C. to 1200° C., e.g. about 1100° Centigrade for a time sufficient for the green electrode to reach a temperature within the preferred range.

The baking may take place in open or closed furnaces, as is well known in the art.

The method of the invention provides carbon electrodes having characteristics including density, air permeability, compressive strength, modulus of elasticity, thermal conductivity, coefficient of thermal conductivity, air reactivity, and carboxy-reactivity which are within acceptable ranges for aluminum smelters.

In another aspect of the present invention, there is provided a carbon electrode, suitable for use an anode in an aluminum reduction cell, which comprises (a) an aggregate comprising a mixture of particulate shot coke and a particulate carbonaceous material other than shot coke, and (b) a coal tar or combination pitch binder, wherein said aggregate comprises a combination of coarse, medium, and fine particles and said particulate shot coke comprises a majority of said fine particulates.

In said electrode, preferably said particulate shot coke is prepared by screening and milling shot coke from a delayed coker to provide a particulate mixture comprising at least 30%, by weight, particles that are fine.

Preferably the particulate carbonaceous material in the electrode is selected from the group consisting of sponge, needle or pitch cokes, and recycled carbon electrode remnants.

While the invention has been described in a preferred embodiment as a method of utilizing shot coke as fine particles to provide a satisfactory carbon electrode, it is also within the scope of the invention, as described, to utilize shot coke to provide the coarse and medium particles that make up the carbon electrodes of this invention.

In this aspect of the present invention, the fines may comprise shot coke, e.g., milled shot coke, or some other particulate carbonaceous material, e.g., fine particulates from the delayed coking of heavy hydrocarbon oil fractions. In this aspect of the method of this invention and the resulting carbon electrodes, like the above preferred embodiment, the aggregate will preferably comprise from 10 to 50 weight percent fine particulates, from 10 to 50 weight percent medium particulates and from 5 to 50 weight percent coarse particulates.

Any of the above, novel electrodes or electrodes made by the method of the present invention may be used in a method for producing aluminum by the molten salt electrolysis of aluminum oxide which comprises electrolyzing aluminum oxide dissolved in a molten salt at an elevated temperature by passing a direct current through an anode to a cathode disposed in said molten salt wherein said anode is any of the above electrodes.

Although there has been hereinabove described a specific electrode useful for molten salt electrolysis of aluminum oxide to aluminum in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A method of making a carbon electrode, suitable for use as an anode in an aluminum reduction cell, which comprises mixing an aggregate, comprising a mixture of particulate shot coke, and a particulate carbonaceous material other than shot coke with coal tar pitch or combination pitch at an elevated temperature to form a paste wherein said aggregate comprises a combination of coarse (including recycled anode butts), medium, and fine particles and said particulate shot coke comprises a majority of said fine particles, and said paste comprises from about 80 to about 90%, by weight, of said aggregate and from about 10 to about 20%, by weight, of said coal tar pitch or combination pitch; forming said paste into a solid body; and baking said solid body at an elevated temperature to form said carbon electrode.

2. The method of claim 1 wherein said shot coke comprises more than 5%, by weight, of said aggregate.

3. The method of claim 2 wherein said shot coke comprises up to 90%, by weight, of said aggregate.

4. The method of claim 1 wherein said carbonaceous material is selected from the group consisting of sponge, needle or coal tar pitch cokes, and recycled carbon electrode remnants.

5. The method of claim 1 wherein said shot coke has a coefficient of thermal expansion of greater than about $20\times10^{-7}$/degrees Centigrade.

6. The method of claim 1 wherein said shot coke has a sulfur content of up to 8%, by weight.

7. The method of claim 1 wherein said shot coke is prepared by screening and milling shot coke from a delayed coker to provide a particulate mixture comprising at least 30%, by weight, of particles that are fine.

8. The method of claim 1 wherein said solid body is subject to compressing or vibrating to form a green anode prior to baking.

9. The method of claim 1 wherein said solid body is baked at a temperature of above 1000° Centigrade.

10. The product of claim 1.

11. A method for producing aluminum by the molten salt electrolysis of aluminum oxide which comprises electrolyzing aluminum oxide dissolved in a molten salt at an elevated temperature by passing a direct current through an anode to a cathode disposed in said molten salt wherein said anode is the product of claim 1.

12. A method of making a carbon anode for use in an aluminum reduction cell, in which aluminum oxide is reduced to molten aluminum metal at an elevated temperature, which comprises:

(a) mixing an aggregate comprising a mixture of particulate shot coke, prepared by screening and milling calcined shot coke to provide a particulate mixture comprising at least 30%, by weight, particles that are fine, and a particulate carbonaceous material selected from the group consisting of sponge, needle or coal tar pitch cokes, and recycled carbon electrode remnants, with coal tar or combination pitches at an elevated temperature to form a paste wherein said aggregate comprises a combination of coarse, medium, and fine particles and said particulate shot coke comprises a majority of said fine particles, and said paste comprises from about 80 to about 90%, by weight, of said aggregate and from about 10 to about 20%, by weight, of said coal tar or combination pitches;

(b) forming said paste into a solid body; (c) subjecting said solid body to compression or vibration to form a green anode; and (d) baking said green anode at an elevated temperature of greater then 1000° Centigrade to form said carbon electrode.

13. The product of claim 12.

14. A carbon electrode, suitable for use as an anode in an aluminum reduction cell, which comprises (a) an aggregate comprising a mixture of particulate shot coke and a particulate carbonaceous material other than shot coke, and (b) a coal tar pitch or combination pitch binder, wherein said aggregate comprises a combination of coarse, medium, and fine particles and said particulate shot coke comprises a majority of said fine particulates.

15. A method of making a carbon electrode, suitable for use as an anode in an aluminum reduction cell, which comprises mixing an aggregate, comprising a mixture of particulate shot coke, and a particulate carbonaceous material other than shot coke with coal tar pitch or combination pitch at an elevated temperature to form a paste wherein said aggregate comprises a combination of coarse (including recycled anode butts), medium, and fine particles wherein said particulate shot coke comprises more than 5%, by weight, of said aggregate, and said paste comprises from about 80 to about 90%, by weight, of said aggregate and from about 10 to about 20%, by weight, of said coal tar pitch or combination pitch; forming said paste into a solid body; and baking said solid body at an elevated temperature to form said carbon electrode.

* * * * *